United States Patent [19]

Kussy et al.

[11] 4,117,290

[45] Sep. 26, 1978

[54] STATIONARY CONTACT COMBINATION

[75] Inventors: Frank W. Kussy, Randallstown; Claudius C. Elmore, Jr., Timonium; Richard E. Molesworth, Westminster, all of Md.

[73] Assignee: Gould Inc., Rolling Meadows, Ill.

[21] Appl. No.: 860,847

[22] Filed: Dec. 15, 1977

[51] Int. Cl.[2] ..... H01H 1/06; H01H 1/20

[52] U.S. Cl. ..... 200/243; 200/275; 200/281; 335/132; 335/197

[58] Field of Search ..... 200/243, 275, 281, 16 A; 335/132, 131, 197, 200; 339/176 S, 91 R, 217 R, 217 S

[56] References Cited

U.S. PATENT DOCUMENTS

| | | | |
|---|---|---|---|
| 3,099,730 | 7/1963 | Tateishi | 335/131 |
| 3,164,709 | 1/1965 | Gentile | 200/281 |
| 3,194,920 | 7/1965 | Scheib, Jr. | 335/131 |
| 3,213,255 | 10/1965 | Kussy et al. | 200/243 |
| 3,324,431 | 6/1967 | Cataldo et al. | 335/132 |
| 3,394,340 | 7/1968 | Kobryner | 339/217 R |
| 3,855,558 | 12/1974 | Hayward | 200/243 |

*Primary Examiner*—William Price
*Assistant Examiner*—Allan N. Shoap
*Attorney, Agent, or Firm*—Ostrolenk, Faber, Gerb & Soffen

[57] ABSTRACT

A stationary contact of an electromagnetic contactor having an insulating contact mounting plate, is part of a contact combination that includes a contact arm, a retainer and a fastening screw for electrically and mechanically securing the contact combination to a terminal of the contactor. The contact is mounted on the forward end of the arm and the retainer, constructed of spring sheet material, engages the rear of the arm. The front of the arm and the retainer cooperate to form a recess which receives and grips an L-shaped formation of the mounting plate.

11 Claims, 6 Drawing Figures

FIG. 4
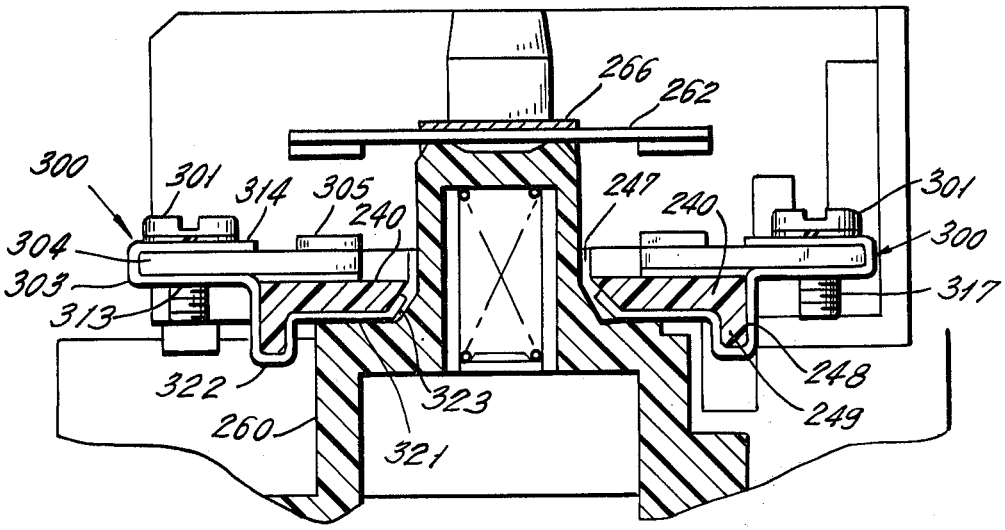
FIG. 5
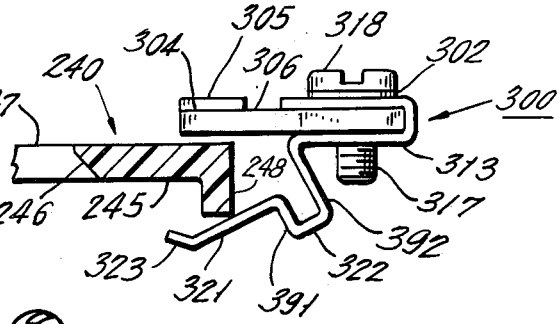
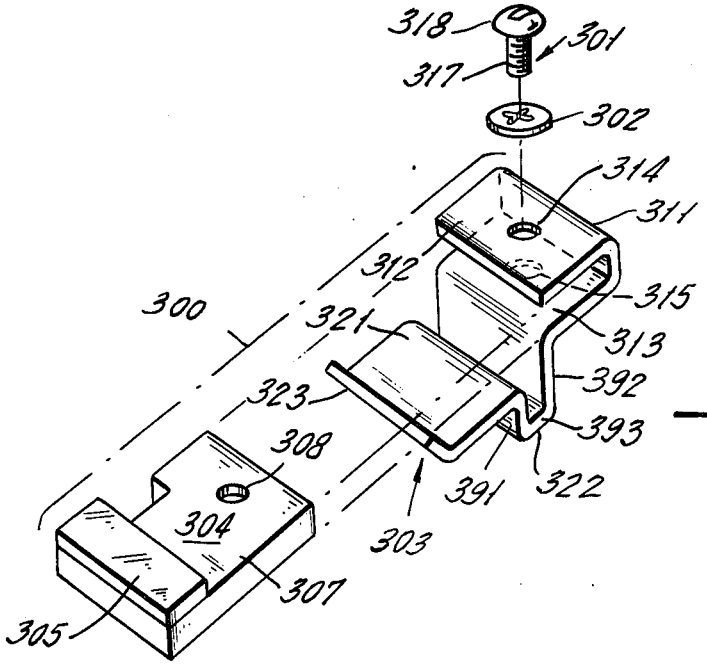
FIG. 6

STATIONARY CONTACT COMBINATION

This invention relates generally to a stationary contact combination which is removably snap-fitted to a contact carrier plate, and relates more particularly to a stationary contact combination which is an improvement over that shown in the copending U.S. patent application Ser. No. 732,976 filed Oct. 18, 1976, by W. H. Hofferberth for a Stationary Contact Combination, and assigned to the assignee of the instant invention.

U.S. Pat. No. 3,213,255 issued Oct. 19, 1965 to F. W. Kussy et al., for a Stationary Contact Combination Including Resilient Retaining Means discloses a frictionally held contact combination for a contactor of the type described in detail in U.S. Pat. No. 3,324,431 issued June 6, 1967 to J. B. Cataldo et al for an Electromagnetic Contactor Having Interchangeable Auxiliary Devices.

In a contactor of the type disclosed in the aforesaid U.S. Pat. No. 3,324,431 there is a contact assembly including a plate and a carrier movable relative to one another. The plate carries all of the stationary contacts and the carrier mounts the movable bridging contacts. When it becomes necessary to inspect or replace the coil of the contact operating electromagnet, the contact assembly is removed from the contactor base. This is readily accomplished by operating the fastening means which connect the main contacts in the load circuit. That is, the same screws that mechanically secure the plate of the contactor assembly to the base of the contactor also provide pressure for electrical contact between the stationary contacts on the plate and terminals on the base of the contactor.

Even though it is necessary to break all of the electrical connections between the contact assembly and base of the contactor in order to gain access to the interior of the base, it is desirable to have the stationary contacts remain mounted to the plate of the contact assembly and not completely fall therefrom or be moved from their operative positions. The aforesaid copending application Ser. No. 732,976 describes a construction in which each stationary contact is mounted on a contact arm which is part of a contact combination. The latter includes a retainer constructed of conducting spring-like sheet material, which engages the contact arm and also cooperates with the contact arm to form a recess which receives a mounting portion of the contact plate for securing the contact combination against accidental removal, yet facilitating mounting and intentional removal.

While the construction described in application Ser. No. 732,976 is a distinct improvement over that construction described in U.S. Pat. No. 3,213,255, there have been instances of rough handling when even the stationary contact combination described in application Ser. No. 732,976 have unintentionally become dislodged from the stationary contact plate. Thus, the instant invention provides a construction which further reduces the likelihood that a stationary contact combination will accidentally become dismounted from the contact mounting plate.

Accordingly, a primary object of the instant invention is to provide an improved construction for a contact assembly which facilitates mounting and dismounting thereof on a contact plate, yet prevents accidental dismounting.

Another object is to provide a novel improved contact combination of this type that is removably snap-mounted to a contact plate.

These objects as well as other objects of this invention shall become readily apparent after reading the following description of the accompanying drawings in which:

In FIG. 1 end portions of the bridging contact at the left pole have been cut away.

FIG. 4 is a fragmentary cross-section taken through line 4—4 of FIG. 1 looking in the direction of arrows 4—4 and illustrating two contact combinations in side elevation.

FIG. 5 is a side elevation showing a contact combination in a partially mounted position on the contact mounting plate.

FIG. 6 is an exploded perspective of a contact combination.

Figure 1:
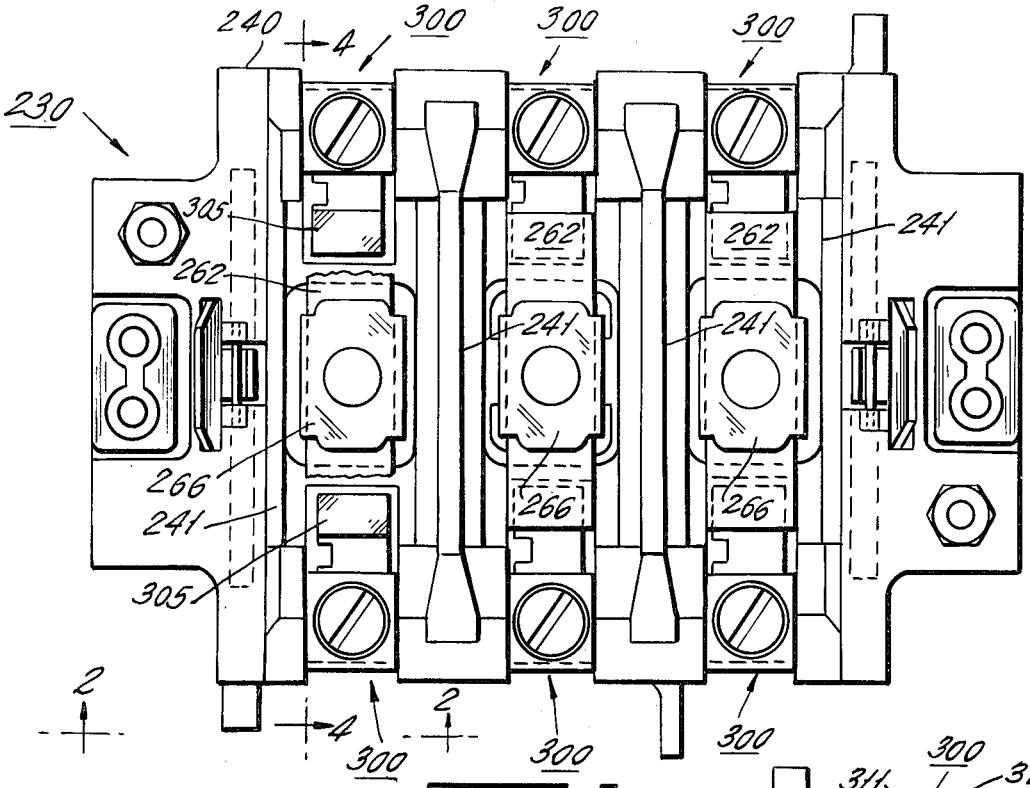
FIG. 1 is a plan view of a contact carrier assembly including stationary contact combinations constructed in accordance with teachings of the instant invention.

Now referring to the drawings and more particularly to FIGS. 4, 5 and 6. Contact combination 300, constructed in accordance with teachings of the instant invention, consists of four separable elements, namely, fastening screw 301, lock washer 302, retainer 303 and stationary contact arm 304 having stationary contact 305 welded or otherwise fixedly secured to the forward section 306 thereof. Rear section 307 of contact arm 304 is provided with clearance aperture 308 for screw 301.

Retainer 303 is constructed of conducting spring material and includes rear portion 311 having parallel arms 312, 313 between which rear section 307 is sandwiched. Apertures 314, 315, through the respective arms 312, 313, are aligned with aperture 308. The threaded portion at the end of screw shank 317 remote from head 318 extends through lock washer 302 and then extends, in order, through apertures 314, 308 and 315. It is noted that aperture 308 is of greater diameter than the outer diameter of the screw thread but that the diameters of apertures 314, 315 are slightly less than the outer diameter of the screw thread so that screw 301 must be threaded onto retainer 303. It is also noted that the portion of shank 317 adjacent to head 318 is undercut.

Retainer 303 also includes front portion 321 connected to rear portion 311 by intermediate portion 322. The latter is U-shaped having arms 391, 392 connected by web 393. Arms 391, 392 are uneven but are proportioned so that front portion 321 is offset in a direction away from the contact arm 306 and in the normal position of FIG. 4 front portion 321 is generally parallel to contact arm 304. The free end of the forward portion 321 is provided with tab 323 which, for reasons to be hereinafter explained, extends toward contact arm 304.

Figure 2:
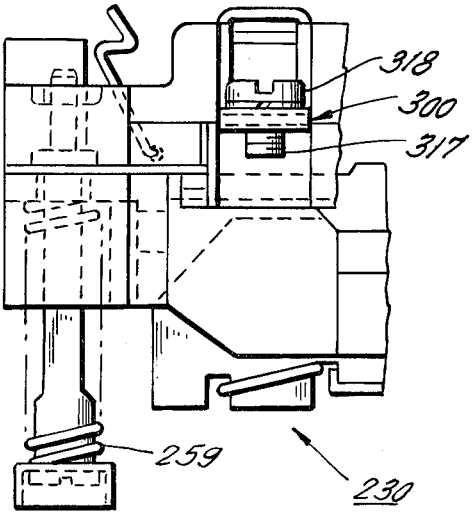
FIG. 2 is a partial end view of the contact carrier assembly looking in the direction of arrows 2—2 of FIG. 1, so as to illustrate an end view of the contact combination.
Figure 3:
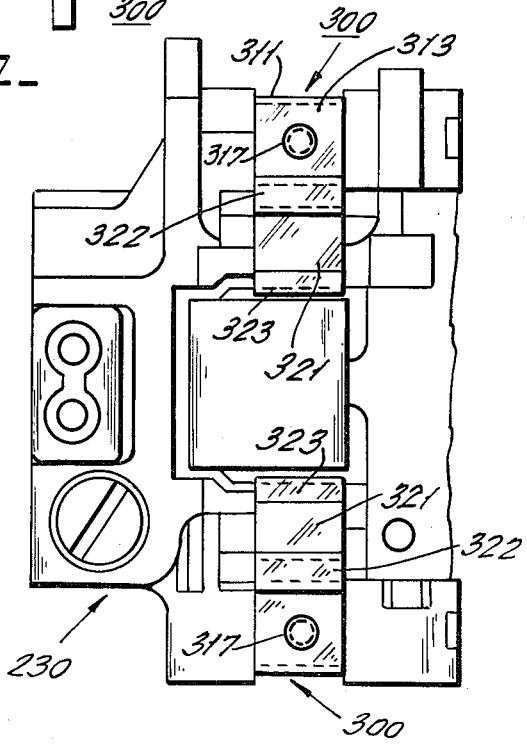
FIG. 3 is a partial bottom view of the contact carrier assembly of FIGS. 1 and 2.

Contact carrier assembly 230 (FIGS. 1 through 3) includes six stationary contact combinations 300 two for each contactor pole. Three contact combinations are mounted along one edge of stationary contact plate 240 and the other three contact combinations 300 are mounted along the opposite edge of plate 240, in a manner to be hereinafter explained. Ribs 241 divide contact plate 240 into a plurality of parallel channels within which stationary contact combinations 300 are mounted. Assembly 230 also includes movable contact carrier 260 which mounts three bridging contacts 262, their retainer means 266 and contact pressure springs 264. A pair of coiled compression springs 259 bear against movable carrier 260 to bias it toward carrier 240.

FIGS. 4 and 5 illustrate the mounting of the contact combination 300 to contact plate 240. In the normal or final mounting position of FIG. 4, it is seen that L-shaped mounting formation 249 of stationary carrier plate 240, extending from edge 248 to aperture 247 thereof and positioned between an adjacent pair of ribs 241, 241, is disposed within recess 325 formed by the front and intermediate portions 321, 322 of contact combination 300 in cooperation with contact arm 304. When the contactor is de-energized springs 259 bias movable contact carrier 240 against front portion 321 to further block dismounting of combination 300.

To mount combination 300, forward portion 321 thereof is deflected away from contact arm 304 until there is a sufficient separation between the free edge of tab 323 and arm 304 to permit contact plate edge 248 to fit therebetween (FIG. 5). Thereafter, combination 300 is moved to the left with respect to FIG. 5 and as the portion of carrier 240 adjacent edge 248 snaps into the portion of recess 325 formed by intermediate portion 322, tab 323 snaps into aperture 247 so that L-shaped mounting formation 249 is disposed within recess 325 and is sandwiched between contact arm 304 and the combination of retainer portions 321, 322. It is noted that during mounting and dismounting of combination 300, movable contact carrier 260 must be moved manually in a downward direction with respect to FIG. 4 to release clamping of forward section 321. The shape of intermediate portion 322, with the spacing between arm 304 and web 393 being approximately twice the spacing between arm 304 and front portion 321, makes it very unlikely that assembly 300 will be dismounted accidentally from stationary contact carrier plate 240. Thus, it is seen that combination 300 is removably snap-fitted to contact carrier plate 240 of contact assembly 230.

Even though stationary contact combination 300 is mounted so that it will not be dislodged accidentally when contact assembly 230 is separated from the contactor base (not shown), the slight rearward slope to surface 246 at the front of mounting formation 249 facilitates intentional removal of combination 300. That is, to remove combination 300 from plate 240 the rear of combination 300 is grasped and pulled to the right with respect to FIG. 4. As the free edge of tab 323 engages sloping surface 246 front retainer portion 321 deflects away from contact arm 304 thereby permitting the free edge of tab 323 to ride on bottom surface 245 of mounting formation 249.

Although a preferred embodiment of this invention has been described, many variations and modifications will now be apparent to those skilled in the art, and it is therefore preferred that the instant invention be limited not by the specific disclosure herein but only by the appended claims.

What is claimed is:

1. A contact combination for an electrical switching device, said combination including a stationary contact arm, a contact positioned at a front section of said arm and mounted on a first surface thereof, an aperture through a rear section of said arm, a retainer constructed of spring metal, said retainer including rear and front portions, said rear portion including spaced arms between which said rear section is sandwiched with said aperture in alignment with aperture means of said rear portion, fastening means extending through said aperture and aperture means for connecting said combination in a circuit, said front portion being offset from said rear section in a first direction away from a second surface of said arm which is opposite said first surface of said arm, said front portion and said front section cooperating to form therebetween a forward portion of a recess means, said retainer also including an intermediate portion disposed between said rear and front portions, said intermediate portion bounding another portion of said recess means extending away from said forward portion in said first direction, said recess means being constructed and operatively positioned to receive a complementary mounting formation of a contact carrier for mechanical securing of said combination in operative position on such carrier.

2. A contact combination as set forth in claim 1 in which the recess means is also bounded by a tab at the front of said front portion, said tab extending toward said second surface in blocking relationship with a mounting formation of a contact carrier.

3. A contact combination as set forth in claim 1 in which the recess means is open at opposite longitudinal sides thereof, said front and intermediate portions being deflectable from normal positions in a direction away from said second surface to permit mounting and dismounting of said combination from a contact carrier by providing a front opening for said recess means through which the latter is enterable by a contact carrier mounting formation by movement of said retainer in a forward direction relative to such contact carrier.

4. A contact combination as set forth in claim 3 in which the recess means is also bounded by a tab at the front portion, said tab extending toward said second surface in blocking relationship with a mounting formation of a contact carrier.

5. A contact combination as set forth in claim 3 in which the front portion in its said normal position extends generally parallel to the second surface.

6. A contact combination as set forth in claim 1 in which the front and intermediate portions are deflectable away from said second surface to permit mounting of said combination to a contact carrier without disassembling said combination or any parts thereof.

7. A contact combination as set forth in claim 6 in which the recess means is also bounded by a tab at the front portion, said tab extending toward said second surface in blocking relationship with a mounting formation of a contact carrier.

8. A contact combination as set forth in claim 1 in which the intermediate portion is generally U-shaped including spaced arms connected by a web, said web being spaced from said second surface by a distance approximately twice as great as the distance between said front portion and said second surface.

9. A contact combination as set forth in claim 1 in which the front portion extends generally parallel to the second surface.

10. A contact combination as set forth in claim 1 in which the intermediate portion is generally U-shaped including spaced arms connected by a web, said web being more distant than said front portion from said second surface, said arms of said intermediate portion being of unequal lengths with the longer of them being connected to the front of said rear portion and the shorter of them being connected to the rear of said front portion.

11. A contact combination as set forth in claim 10 in which said arms of said intermediate portions extend generally perpendicular to the second surface.

* * * * *